US005794310A

United States Patent [19]

Dallmann

[11] Patent Number: 5,794,310

[45] Date of Patent: Aug. 18, 1998

[54] ADJUSTABLE WINDOW HINGE

[75] Inventor: Brian D. Dallmann, Owatonna, Minn.

[73] Assignee: Truth Hardware Corporation, Owatonna, Minn.

[21] Appl. No.: 805,123

[22] Filed: Feb. 24, 1997

[51] Int. Cl.[6] ..... E05D 15/00

[52] U.S. Cl. ..... 16/362; 16/235; 16/368; 16/239

[58] Field of Search ..... 16/235, 273, 240, 16/366, 371, 362, 368, 239, DIG. 34, 369, 370; 49/396, 246, 250–252, 266; 403/119, 153–155

[56] References Cited

U.S. PATENT DOCUMENTS

| | | | |
|---|---|---|---|
| Re. 32,846 | 1/1989 | Sandberg et al. . | |
| 1,499,540 | 7/1924 | Lea . | |
| 1,710,171 | 4/1929 | Lindsay . | |
| 2,688,779 | 9/1954 | Westman . | |
| 2,926,397 | 3/1960 | Vuncannon . | |
| 3,234,584 | 2/1966 | Valade | 16/273 |
| 3,725,973 | 4/1973 | Gwozdz | 16/273 |
| 3,939,529 | 2/1976 | Davis | 16/273 |
| 4,226,002 | 10/1980 | Davis | 16/273 |
| 4,388,744 | 6/1983 | Pantke et al. | 16/273 |
| 4,475,266 | 10/1984 | Suska | 16/273 |
| 4,674,149 | 6/1987 | Vetter . | |
| 4,726,092 | 2/1988 | Tacheny et al. . | |
| 4,790,106 | 12/1988 | La See . | |
| 4,833,754 | 5/1989 | Yang . | |
| 4,986,028 | 1/1991 | Schneider . | |
| 5,074,075 | 12/1991 | La See . | |
| 5,152,102 | 10/1992 | La See . | |
| 5,307,539 | 5/1994 | Bauman . | |

FOREIGN PATENT DOCUMENTS

| | | |
|---|---|---|
| 376488 | 7/1932 | United Kingdom . |
| 1137878 | 12/1968 | United Kingdom . |

*Primary Examiner*—Chuck Mah

*Attorney, Agent, or Firm*—Wood, Phillips, VanSanten, Clark & Mortimer

[57] ABSTRACT

A connection for adjustably holding a sash arm and a support arm in pivotally connected relationship, including a sash arm having a first cylindrical opening, a support arm having a second cylindrical opening at one end, and a stud. The stud includes a pivot portion with a cylindrical shaft extending through the second cylindrical opening, a rivet portion extending from one end of the cylindrical shaft through the first cylindrical opening and eccentric to the pivot portion cylindrical shaft, and a head on an end of the rivet portion spaced from the cylindrical shaft wherein the head and the one end of the cylindrical shaft engage opposite sides of the sash arm to frictionally secure the stud against pivoting relative to the sash arm. The first cylindrical opening includes a countersunk hole on the side of the sash arm attachable to a window sash, wherein the rivet portion head is formed substantially entirely in the countersunk hole. A plastic washer is disposed about the cylindrical shaft between the sash arm and support arm, and has an outer diameter which is less than the width of the sash arm and support arm. A hexagonal shaped aperture is formed on the shaft head and is engageable with an L-shaped hex wrench to allow for adjustment of the pivotal connection by pivoting the stud between frictionally secure positions relative to the sash arm.

20 Claims, 1 Drawing Sheet

ADJUSTABLE WINDOW HINGE

BACKGROUND OF THE INVENTION

1. Technical Field

The present invention is directed toward casement hinges for windows and, more particularly, toward an improved adjustable pivot in casement hinges.

2. Background Art

Casement windows generally include a window sash movably mounted within a window frame by a pair of hinges. The hinges are generally mounted between the window frame and sash at the top and bottom of the window sash. Such hinges typically include a track fixedly mountable to the window frame and a sash arm fixedly connectable to the window sash. A support arm is interconnected between the track and sash arm, with the support arm being pivotally connected to both the sash arm and the track. The sash arm is pivotally connected to a mounting shoe, which is supported by and guided for movement along the length of the track. Window hinges of this type are generally shown, for example, in U.S. Pat. No. 4,726,092 to Tacheny et al. and U.S. Pat. No. Re. 32,846 to Sandberg et al., which patents are incorporated herein by reference.

U.S. Pat. No. 4,674,149 to Vetter, incorporated herein by reference, discloses a variation on the above-described hinge. The disclosed hinge includes an intervening link between the sash arm and the movable shoe which provides for an offset sash arm. Window hinges of this type typically include a second intervening link between the support arm and the movable shoe to provide further support.

Upon installation, window hinges of the above type require that the fixed track pivot, usually between the support arm and the window frame, be properly located relative to the window sash for proper operation and sealing of the window when closed. However, the proper location of the fixed track pivot may change over the life of the window due to slight shifting of the window, window frame, etc., resulting in the sash having a sagging appearance, i.e., sash sag. The term sash sag is used to define the condition formed when the sash and the frame of a window are no longer square to one another in the closed position, or the edge of the sash which is opposite the hinges seems to sag in comparison to the frame of the window. As a result of this "sash sag", the window may not seal tightly or open and/or close easily.

Precise installation of the hinge and subsequent correction of sash sag has usually required that the hinge track be provided with slotted holes and that the mounting screws in the slotted holes be removed to allow for shifting of the track. However, over the life of a window, repeated removal of the mounting screws can result in a gradual decrease in the strength of the mounting. Further, setting the track to properly position the window sash in the frame may require that the window be first opened to allow access to the hinge for adjustment and then closed to check the sash alignment. If the adjuster securely tightens the mounting screws before checking the sash alignment, subsequent adjustments, if necessary, require the adjuster to loosen the screws, further adding to the potential loss of strength in the mounting. On the other hand, if the adjuster chooses to check the sash alignment before securely tightening the mounting screws, the track may slip when the window is reopened to permit access to the screws for tightening. If the adjuster does not notice that the track has slipped, the track, once finally tightened, may still be slightly misaligned.

U.S. Pat. No. 5,307,539 to Bauman, assigned to the assignee hereof and incorporated herein by reference, discloses an adjustable casement hinge which is an improvement over the above-described hinges. The disclosed hinge includes a stud providing an adjustable pivot connection between the support arm and the track. Rotation of the stud adjusts the pivot axis of the support arm, which in turn aids in the correction of sash sag.

The present invention is directed toward overcoming one or more of the problems discussed above.

SUMMARY OF THE INVENTION

In one aspect of the present invention, a window hinge for supporting a window sash relative to a window frame is provided, including a track for mounting to a window frame, a sash arm for mounting to a window sash and connected at one end to a first pivot secured to the track, and a support arm connected at one end to a second pivot secured to the track, with one of the first and second pivots being fixed relative to the track. An adjustable pivot is provided between the support arm and the other end of the sash arm, and includes a first cylindrical opening in the sash arm, a second cylindrical opening in the support arm, and a stud. The stud includes a pivot portion with a cylindrical shaft extending through the second cylindrical opening, a rivet portion extending from one end of the cylindrical shaft through the first cylindrical opening and eccentric to the pivot portion cylindrical shaft, a head on an end of the rivet portion spaced from the cylindrical shaft wherein the head and the one end of the cylindrical shaft engage opposite sides of the sash arm to frictionally secure the stud against pivoting relative to the sash arm, means for securing the support arm to the pivot portion for pivoting about the cylindrical shaft, and means engageable by a torque applying tool for turning the stud between frictionally secure positions relative to the sash arm.

In another aspect of the present invention, the turning means comprises a non-circular shaped aperture formed on the other end of the cylindrical shaft engageable with a similarly shaped end of the torque applying tool for turning the stud between frictionally secure positions relative to the sash arm. In a preferred form, the non-circular shaped aperture has a hexagonal shape.

In still another aspect of the present invention, a washer is disposed about the cylindrical shaft between the sash arm and support arm. In preferred forms of this aspect of the present invention, the washer has an outer diameter which is less than the width of the sash arm and support arm, and has a lower coefficient of friction than the outer surface of at least one of the sash arm and support arm. In still another preferred form, the washer is made of a plastic.

In yet another aspect of the present invention, the fixed one of the first and second pivots on the track includes means for selectively adjusting the pivot axis relative to the track. In a preferred form, such selective adjustment is provided by a track stud having a first shaft extending through an opening in the track and a second shaft extending through an opening in the pivoted arm, where one of the first and second shafts is selectively securable against pivoting relative to the opening through which it extends, and the first and second shafts are eccentric to each other.

In another aspect of the present invention, the first cylindrical opening includes a countersunk hole on the side of the sash arm attachable to a window sash, wherein the rivet portion head is formed substantially entirely in the countersunk hole.

In still another aspect of the present invention, a connection for adjustably holding a sash arm and a support arm in pivotally connected relationship is provided, and includes a first cylindrical opening in the sash arm, a second cylindrical opening in the support arm, and a stud. The stud includes a pivot portion with a cylindrical shaft extending through the second cylindrical opening, a rivet portion extending from one end of the cylindrical shaft through the first cylindrical opening and eccentric to the pivot portion cylindrical shaft, a head on an end of the rivet portion spaced from the cylindrical shaft wherein the head and the one end of the cylindrical shaft engage opposite sides of the sash arm to frictionally secure the stud against pivoting relative to the sash arm, means for securing the support arm to the pivot portion for pivoting about the cylindrical shaft, and means engageable by a torque applying tool for turning the stud between frictionally secure positions relative to the sash arm.

It is an object of the present invention to provide a window hinge which may be easily and precisely installed.

It is another object of the present invention to provide a window hinge which may be easily adjusted over the life of the window to ensure that a tight seal is provided when the window is closed and the window is easily and smoothly operated at all times.

It is another object of the present invention to provide a window hinge which may not only be adjusted, but allows a user to easily and accurately gauge the amount of adjustment made.

It is still another object of the present invention to provide a hinge which may be easily adjusted without weakening the hinge components and/or the attachment of the hinge to the window frame and sash.

DETAILED DESCRIPTION OF THE PREFERRED EMBODIMENT

Figure 1:
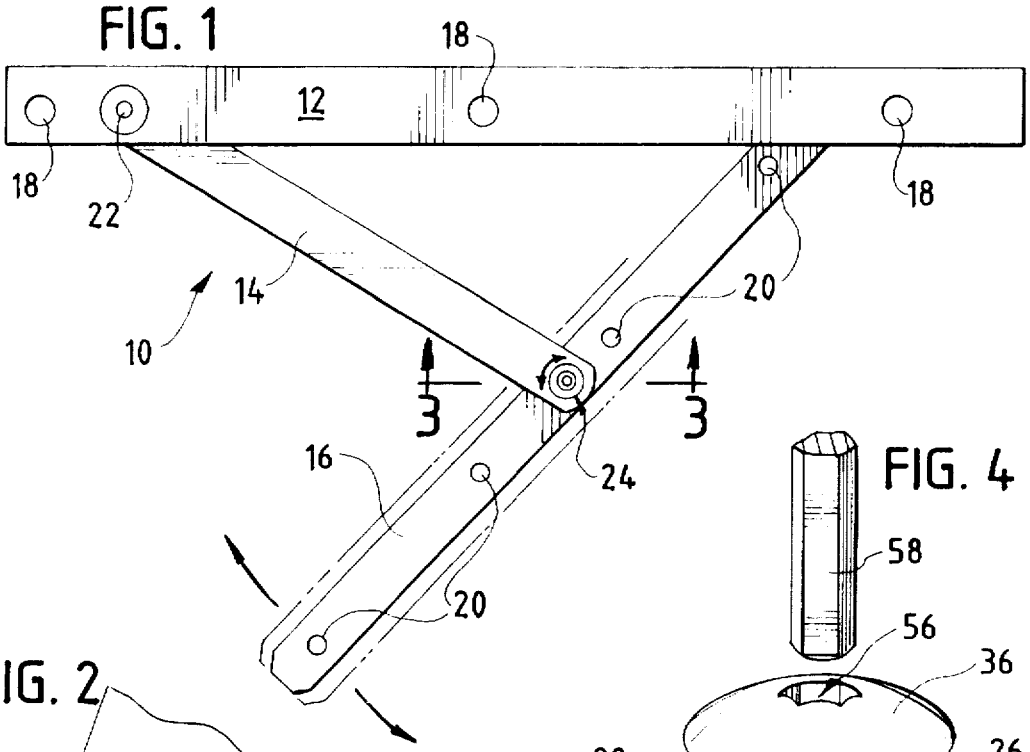
FIG. 1 is a bottom plan view showing a window hinge including the adjustable pivot of the present invention.

A casement hinge, shown generally at 10, embodying the adjustable pivot of the present invention is shown in FIG. 1. The hinge 10 includes a track 12, a support arm 14, and a sash arm 16. Note that although the description herein generally refers to a casement window which is supported for pivoting about a vertical axis, the invention disclosed herein could also be used with other types of window hinges, including specifically hinges supporting awning windows for pivoting about a horizontal axis.

The track generally includes a plurality of openings 18 extending therethrough through which screws (not shown) or other similar mounting devices may be inserted for mounting the track 12 to a window frame (not shown). Inasmuch as the present invention alleviates the need for shifting of the track 12, as will hereafter become apparent, the track openings 18 may be shaped to securely mount the track 12 against any longitudinal movement with respect to the frame. Preferably, the track openings 18 are circular.

The sash arm 16 includes a plurality of openings 20 extending therethrough, through which suitable screws (not shown), or other conventional mounting means, may be inserted for mounting sash arm 16 to a side of a window sash (not shown) such that the casement hinge 10 operably connects the window sash to the window frame enabling the window to be suitably opened and closed by a user.

One end of the sash arm 16 is connected to a sliding shoe (not shown) by a rivet (not shown), or other suitable connecting means, for pivotable connection therebetween. The shoe is suitably secured to the track 12 for longitudinal movement along the length of the track 12.

One end of the support arm 14 is pivotally connected to a point selectively fixed on the track 12 by a suitable rivet 22. The other end of the support arm 14 is pivotally connected to the sash arm 16 at an intermediate location thereon in a manner as will be described in greater detail hereafter.

Those skilled in the art will readily understand that the description given above is one type of conventional arrangement for a window casement hinge. Once an understanding of the present invention is gained by those of ordinary skill in the art, it will also be recognized that the present invention, as described hereafter, may also be advantageously used with other types of hinges (including, e.g., hinges in which the sash arm has a fixed pivot axis relative to the track and the support arm is pivotally connected to a movable shoe), as well as with various other pivot connections of window hardware where adjustment may be required.

Figure 2:
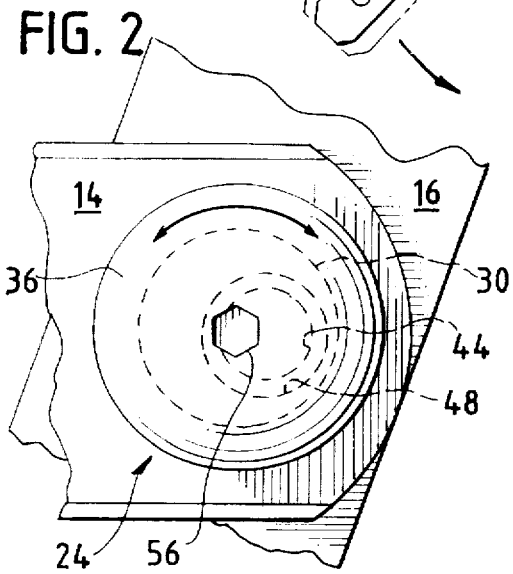
FIG. 2 is a bottom view of the adjustable pivot of the present invention.
Figure 4:
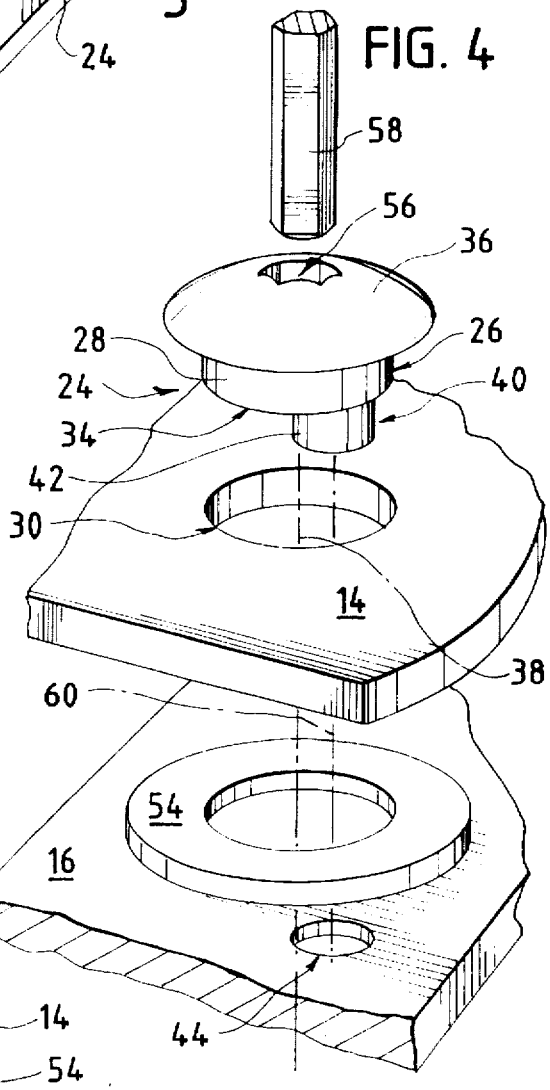
FIG. 4 is an exploded perspective view of the adjustable pivot of the present invention, including a torque applying tool.
Figure 3:
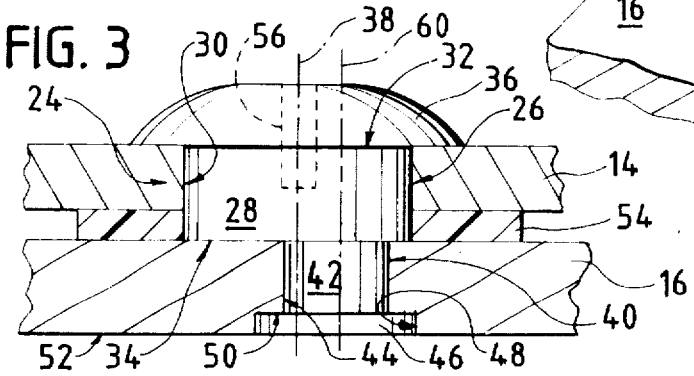
FIG. 3 is a cross-sectional view taken along line 3—3 of FIG. 1 showing the adjustable pivot of the present invention.

FIGS. 2–4 depict a structure for providing the pivotal connection between the support arm 14 and the sash arm 16. More specifically, a stud 24 is provided with a pivot portion 26 including a cylindrical shaft 28 which extends through a matching cylindrical opening 30 in the support arm 14. The cylindrical shaft 28 includes opposing ends 32, 34.

A rivet head 36 is suitably formed on the end 32 of the cylindrical shaft 28 to allow relatively free pivoting of the support arm 14 relative to the stud 24 about the pivot axis 38 of shaft 28. Alternatively, an external peripheral groove could be provided in the shaft, with a C-ring of substantially incompressible spring-type material extending through more than 180° and in the groove. With such a connection (as is shown in U.S. Pat. Nos. 4,593,431 and Re. 32,846, the contents of which are hereby incorporated by reference), the C-ring preferably has inner and outer diameters selected to have a part thereof in the peripheral groove and a part extending radially outwardly beyond the periphery of the pivot portion shaft when the C-ring is in a securing position, where the peripheral groove has a depth to enable deformation of the C-ring by movement of the spaced-apart ends towards each other to a release position in which substantially all of the C-ring is in the peripheral groove.

A rivet portion 40 extends from the end 34 of the cylindrical shaft 28 and includes a cylindrical neck or tenon 42 which extends through a matching cylindrical opening 44 in the sash arm 16, with the cylindrical neck 42 having an axis 60 generally eccentric from the axis 38 the cylindrical shaft 28.

A rivet head 46 is suitably formed on the end of the cylindrical neck 42 during assembly so that the end 34 of the cylindrical shaft 28 and the rivet head 46 generally engage opposite sides of the sash arm 16 to frictionally secure the stud 24 against freely pivoting relative to the sash arm 16, as described hereafter. The rivet head 46 is preferably received in a countersunk opening 48 formed in the sash arm 16. By providing a rivet portion 40 which allows for the rivet head 46 to be substantially contained in the countersunk opening 48, the side 52 (see FIG. 3) of the sash arm 16 may be positioned substantially flush against the side of the window sash when attached thereto.

Countersunk opening 48 is concentric with the cylindrical opening 44 in the sash arm 16 and includes an annular shoulder 50 which abuts the rivet head 46 to frictionally secure the stud 24 against freely pivoting relative to the sash arm 16. The axially extending sides of the opening 48 also may engage the sides of the rivet head 46 to further frictionally secure the stud 24 against freely pivoting relative to the sash arm 16. The rivet head may also rub against an attached sash to further provide frictional securing against pivoting. As such, this compact structure may be securely held by friction with surrounding surfaces to prevent undesired pivoting of the stud 24.

A washer 54 is provided about the cylindrical shaft 28 and is generally disposed between the support arm 14 and sash arm 16. The washer 54 is preferably made of a synthetic polymer resin material, such as plastic or the like, to preferably provide for smooth pivoting of the support arm 14 and the sash arm 16 relative to one another, and to further provide a stable pivotal connection between the support arm 14 and the sash arm 16 to ensure proper overall strength of the casement hinge 10.

Although the washer 54 is preferably smooth so as to provide reduced friction, it will nevertheless encounter some frictional forces, particularly static friction with the sash arm 16. Since adjustment of the hinge 10 as described below requires that not only the stud 24 be moved relative to the sash arm 16 but also the washer 54, the washer 54 will also provide some frictional resistance against the stud 24 pivoting from its set position. Such resistance would be particularly great in the bottom hinge of a casement window, inasmuch as the weight of the window sash would press down on the sash arm 16, biasing the arm 16 toward the support arm 14 so as to squeeze the washer 54 therebetween and maximize the axial forces giving rise to static friction therebetween.

As will be apparent to one of ordinary skill in the art, once a complete understanding of the present invention is obtained, adjustment of the above-described casement hinge 10 can be simply accomplished. When sag is detected in the supported window sash (either at initial installation or over the life of the window), it may be easily corrected by pivoting the stud 24 to effectively move the pivot axis 38 defined by the stud cylindrical shaft 28 longitudinally along the sash arm 16.

More specifically, a hexagonal shaped aperture 56 is formed in the rivet head 36 of the stud 24. By engaging a suitable tool with the stud 24, such as a hex wrench 58 in a mating aperture 56 in the rivet head 36 as illustrated in FIG. 4, a user can develop a sufficient moment arm to overcome the strong static friction forces holding the stud 24 against movement relative to the sash arm 16, and can thereby turn the stud 24 about the eccentric axis 60 of the rivet portion 40 to a new position. Once so pivoted, the static frictional forces between the sash arm 16 and the stud 24 (that is, with the rivet head 46 and the end 34 of the cylindrical shaft 28) will again secure the stud 24 against movement relative to the sash arm 16.

Due to the eccentricity of the pivot portion 26, which defines the pivot axis 38 of the support arm 14, relative to the rivet portion 40, which defines the rivet axis 60 about which the stud 24 is turned, turning the stud 24 about the rivet axis 60 shifts the pivot portion 26 through an infinite number of positions so as to adjust the pivot axis 38 of the support arm 14 relative to the sash arm 16, thereby effectively shifting the position of the window sash fixed to the sash arm 16 relative to the window frame (fixedly pivoted to the support arm 14). Thus, this simple turning operation can be used to shift the pivot axis 38 relative to the frame as needed to correct for sag of the supported window sash.

Further, by permitting adjustments to be made by changing the pivot axis 38 of the support arm 14 on the sash arm 16, the present invention permits the user to more accurately gauge the amount of adjustment necessary to correct for the sag of the supported window sash. This permits for ease of adjustment since the user does not have to fully open the window, make an adjustment, and then close the window to see if the adjustment has corrected for sag, in which case, if the adjustment failed to fully correct for the sash sag, the user had to repeat the steps of opening the window, etc. That is, with the present invention, the user need only open the window sash a small amount in order to gain access to the aperture 56 in the stud 24, so that a user can more accurately gauge the amount of adjustment necessary to correct for the sash sag. Further, even if readjustment of the window sash is required to get the precisely desired alignment, only minimal movement of the window sash is required to reopen the sash to again gain access to the stud aperture 56.

Still further, since the adjustment range of hinge 10 occurs with a 180° rotation of the stud 24, using an L-shaped hex wrench allows a user to use the wrench position to easily gauge the degree of adjustment, to thereby allow for quick and accurate adjustments.

Also, since thicker gauge materials are typically used for the support arm 14 and sash arm 16 than are used for the track 12, the adjustable stud 24 does not detract from the strength of the hinge 10 as might occur if the relatively weak track 12 were modified to accommodate the stud 24 (or alternatively, the cost of the hinge may be minimized by allowing use of conventional tracks made of lower gauge materials.

As an additional feature, the adjustable hinge of the present invention could also incorporate a second adjustable pivot at the pivotal connection between the support arm 14 and track 12 as taught in U.S. Pat. No. 5,307,539. Such a combination would provide further sag adjustment capabilities by effectively providing the added the adjustment amounts provided by both adjustable pivots.

Finally, as will be apparent to one of ordinary skill in the art once an understanding of the present invention is obtained, the static friction forces between the rivet head 46, end 34 of the cylindrical shaft 28, cylindrical neck 42, and sash arm 16 must be great enough to hold the stud 24 against movement relative to the sash arm 16, but loose enough to reasonably permit overcoming that static friction to allow rotation of the shaft with a torque applying tool such as an L-shaped hex wrench, screwdriver, etc. If the joint formed by forming the rivet head 46 is made too tight, a user may not be able to pivot the stud 24 and sag adjustments could not be made. On the other hand, if the joint is made too loose, the slipping of the stud 24 relative to the movement of the sash arm 16 will both encourage sag of the supported window sash and prohibit the correction thereof.

The torque at which the rivet head 46 needs to be formed in order to hold the stud 24 against movement relative to the sash arm 16, and also allow the stud 24 to be turned about the axis 60 of the rivet portion 40, will accordingly depend upon the materials used for the sash arm 16, support arm 14, and stud 24, and any coatings, if applicable, applied to those elements, as well as depending upon the size of these components and the loads expected to be encountered during the life of a hinge 10. For instance, if the hardware components were coated with a material having a Teflon® base, more torque would be desired when forming the rivet head 46, since Teflon® normally promotes a slicker surface. On the other hand, a lesser amount of torque would be required to form the rivet head 46 if the materials were uncoated. Further, if the rivet head 46 and related countersunk opening 48 are made larger, or if the shaft end 34 is enlarged, the frictionally engaging surfaces would typically be increased and the normal forces required to provide a given overall static friction resistance to movement would be less, in which case less torque for forming the rivet head 46 might be used. In this regard, the following procedures for forming the rivet head 46 have been found to be suitable:

Example 1

Sash arm material/coating: Uncoated stainless steel

Rivet neck diameter: 0.149±0.003 inch

Rivet neck length: 0.175±0.005 inch

Countersunk hole: 0.219±0.010 inch diameter×90°

Turn rivet for 2.3 seconds at 45 lb/in$^2$ pressure

Example 2

Sash arm material/coating: Steel with multilayer electrocoat (modified zinc phosphate coating, covered by a non-chrome seal, covered by a cathodic electrocoat with an anti-friction additive)

Rivet neck diameter: 0.149±0.003 inch

Rivet neck length: 0.175±0.005inch

Countersunk hole: 0.219±0.010inch diameter×90°

Turn rivet for 1.6 seconds at 60 lb/in$^2$ pressure

It is thus apparent that hinges embodying the present invention can be easily and precisely installed. Such hinges will remain securely mounted, thus minimizing undesirable shifting of the pivot over the life of the window. Such hinges embodying the present invention may be easily adjusted over the life of the window to correct for any "sash sag" which may develop to ensure that a tight seal is provided when the window is closed and that the window may be easily and smoothly operated at all times.

Still other aspects, objects, and advantages of the present invention can be obtained from a study of the specification, the drawings, and the appended claims.

I claim:

1. In a window hinge having a track for mounting to a window frame, a sash arm for mounting to a window sash and connected at one end to a first pivot secured to the track, and a support arm connected at one end to a second pivot secured to the track, with one of said first and second pivots being fixed relative to the track, an adjustable pivot between the support arm and the other end of the sash arm comprising:

a first cylindrical opening in the sash arm;

a second cylindrical opening in the support arm; and a stud including:

a pivot portion including a cylindrical shaft extending through the second cylindrical opening;

a rivet portion extending from one end of the cylindrical shaft through the first cylindrical opening, said rivet portion being eccentric to said pivot portion cylindrical shaft;

a head on an end of the rivet portion spaced from the cylindrical shaft, wherein the head and the one end of the cylindrical shaft engage opposite sides of the sash arm to frictionally secure the stud against pivoting relative to the sash arm;

means for securing the support arm to the pivot portion for pivoting about the cylindrical shaft; and means engageable by a torque applying tool for turning the stud between frictionally secure positions relative to the sash arm.

2. The adjustable pivot of claim 1, wherein the turning means comprises a non-circular shaped aperture formed on the other end of the cylindrical shaft engageable with a similarly shaped end of the torque applying tool for turning the stud between frictionally secure positions relative to the sash arm.

3. The adjustable pivot of claim 2, wherein the non-circular shaped aperture has a hexagonal shape.

4. The adjustable pivot of claim 1, further comprising a washer disposed about the cylindrical shaft between the sash arm and support arm.

5. The adjustable pivot of claim 4, wherein the securing means comprises a head formed on the other end of the cylindrical shaft, the head engaging a side of the support arm opposite the side engaged by the washer for securing the support arm to the pivot portion for pivoting about the cylindrical shaft, and the turning means comprises a non-circular shaped aperture formed on the shaft head engageable with a similarly shaped end of the torque applying tool for turning the stud between frictionally secure positions relative to the sash arm.

6. The adjustable pivot of claim 5, wherein the non-circular shaped aperture has a hexagonal shape.

7. The adjustable pivot of claim 4, wherein the washer has an outer diameter which is less than the width of the sash arm and support arm.

8. The adjustable pivot of claim 7, wherein the outer surface of the washer has a lower coefficient of friction than the outer surface of at least one of the sash arm and support arm.

9. The adjustable pivot of claim 8, wherein the washer is made of a plastic.

10. The adjustable pivot of claim 1, wherein the fixed one of the first and second pivots on the track includes means for selectively adjusting the pivot axis relative to the track.

11. The adjustable pivot of claim 10, wherein the adjusting means includes a track stud having a first shaft extending through an opening in the track and a second shaft extending through an opening in the pivoted arm, one of said first and second shafts being selectively securable against pivoting relative to the opening through which it extends, and said first and second shafts being eccentric to each other.

12. The adjustable pivot of claim 1, wherein the first cylindrical opening includes a countersunk hole on the side of the sash arm attachable to a window sash, wherein said rivet portion head is formed substantially entirely in the countersunk hole.

13. A connection for adjustably holding a sash arm and a support arm in pivotally connected relationship, said connection comprising:

a sash arm having a first cylindrical opening;

a support arm having a second cylindrical opening at one end; and a stud including:

a pivot portion including a cylindrical shaft extending through the second cylindrical opening;

a rivet portion extending from one end of the cylindrical shaft through the first cylindrical opening, said rivet portion being eccentric to said pivot portion cylindrical shaft;

a head on an end of the rivet portion spaced from the cylindrical shaft, wherein the head and the one end of the cylindrical shaft engage opposite sides of the sash arm to frictionally secure the stud against pivoting relative to the sash arm;

means for securing the support arm to the pivot portion for pivoting about the cylindrical shaft; and means engageable by a torque applying tool for turning the stud between frictionally secure positions relative to the sash arm.

14. The connection of claim 13, wherein the turning means comprises a non-circular shaped aperture formed on the other end of the cylindrical shaft engageable with a similarly shaped end of the torque applying tool for turning the stud between frictionally secure positions relative to the sash arm.

15. The connection of claim 14, wherein the non-circular shaped aperture has a hexagonal shape.

16. The connection of claim 13, further comprising a washer disposed about the cylindrical shaft between the sash arm and support arm.

17. The connection of claim 16, wherein the washer has an outer diameter which is less than the width of the sash arm and support arm.

18. The connection of claim 17, wherein the outer surface of the washer has a lower coefficient of friction than the outer surface of at least one of the sash arm and support arm.

19. The connection of claim 18, wherein the washer is made of a plastic.

20. The connection of claim 13, wherein the first cylindrical opening includes a countersunk hole on the side of the sash arm attachable to a window sash, wherein said rivet portion head is formed substantially entirely in the countersunk hole.

* * * * *